United States Patent [19]

Bowman

[11] Patent Number: 4,620,368

[45] Date of Patent: Nov. 4, 1986

[54] CARPET CUTTING TOOL

[76] Inventor: Terry R. Bowman, 4524 S. Union, Tulsa, Okla. 74107

[21] Appl. No.: 689,311

[22] Filed: Jan. 7, 1985

[51] Int. Cl.[4] ..... B26B 29/00

[52] U.S. Cl. ..... 30/294; 30/329; 30/335; 30/339

[58] Field of Search ..... 30/170, 171, 287, 294, 30/329, 335, 339, 280, 296 R; 7/103

[56] References Cited

U.S. PATENT DOCUMENTS

| | | | |
|---|---|---|---|
| 625,550 | 5/1889 | Geisendorff et al. | 30/294 |
| 2,282,729 | 5/1942 | Knauf | 30/294 |
| 2,601,414 | 6/1952 | Mittelstaedt | 30/294 |
| 2,770,879 | 11/1956 | Seymour | 30/335 |
| 2,806,283 | 9/1957 | Brennon | 30/294 |
| 2,907,106 | 10/1959 | Lockwood | 30/169 |
| 3,859,725 | 6/1975 | Anderson et al. | 30/294 |
| 3,934,341 | 6/1976 | Carlson | 30/294 X |
| 4,064,627 | 12/1977 | Zanfini | 30/294 X |
| 4,100,636 | 7/1978 | Ott et al. | 30/286 X |
| 4,103,421 | 8/1978 | Quenot | 30/162 |
| 4,114,216 | 9/1978 | Gatby | 7/116 |

FOREIGN PATENT DOCUMENTS

| | | | |
|---|---|---|---|
| 0437406 | 4/1912 | France | 30/294 |
| 1285958 | 8/1972 | United Kingdom | 30/294 |

*Primary Examiner*—Robert L. Spruill
*Assistant Examiner*—Taylor J. Ross
*Attorney, Agent, or Firm*—Head, Johnson & Stevenson

[57] ABSTRACT

A tool for facilitating the cutting of carpet which has been installed on a floor surface by glueing, or the lie, the tool comprising a pair of substantially identical plates secured in planar abutting relation, each plate being provided with an angularly orientated recess on the inwardly directed surface thereof, each recess for slidably receiving a cutting blade therein, fastening members are provided for removably securing the blades within the respective recess and for facilitating longitudinal adjustment of each blade within its respective recess for exposing a selected cutting edge of a blade for accomplishing the cutting operation, and an elongated handle member pivotally secured to the plates whereby the cutting tool may be moved across the surface of the carpet during the cutting operation while the operator of the tool remains in a substantially upright position.

5 Claims, 9 Drawing Figures

CARPET CUTTING TOOL

BACKGROUND OF THE INVENTION

1. Field of the Invention

This invention relates to improvements in carpet cutting tools and more particularly, but not by way of limitation, to a carpet cutting tool for the cutting of installed or laid carpet for facilitating the removal thereof.

2. Description of the Prior Art

In many carpet installations the carpet is glued or otherwise secured or adhered to the surface of the floor upon which it has been laid. In order to remove the carpet it is necessary to cut the carpet the entire length of the room at spaced intervals of approximately ten inches. The normal manner in which this is accomplished by presently available tools comprises the use of a relatively small hand tool having a cutting blade generally similar to a razor blade, but much stronger, and crawling along the floor simultaneously with the cutting operation. The disadvantages of this procedure will be self-evident.

There have been many carpet cutting tools developed for facilitating the cutting of carpet. Examples of these tools are shown in the Knauf U.S. Pat. No. 2,282,729, issued May 12, 1942, and entitled "Cutting Tool;" the Mittelstaedt U.S. Pat. No. 2,601,414, issued June 24, 1952, and entitled "Fabric Cutter;" the Brennan U.S. Pat. No. 2,806,283, issued Sept. 17, 1957, and entitled "File Fabric Trimming Device;" the Lockwood U.S. Pat. No. 2,907,106, issued Oct. 6, 1959, and entitled "Hand Tool for Removing Floor Coverings;" the Anderson et al U.S. Pat. No. 3,859,725, issued Jan. 14, 1975, and entitled "Carpet Cutting Tool;" the Ott et al U.S. Pat. No. 4,100,636, issued July 18, 1978 and entitled "Cutter;" the Quenot U.S. Pat. No. 4,103,421, issued Aug. 1, 1978, and entitled "Blade-Holding Cutting Device;" and the Batby U.S. Pat. No. 4,114,216, issued Sept. 19, 1978, and entitled "Combination Tool." Most of these devices are concerned with the cutting of carpet or other fabrics which have not yet been installed, and the Lockwood device does not eliminate the disadvantage of crawling along the floor during the carpet removal operation.

SUMMARY OF THE INVENTION

The present invention contemplates a novel carpet cutting tool which has been particularly designed and constructed for overcoming the foregoing disadvantages. The novel tool comprises a pair of plates disposed in planar butting relationship and each having an angularly disposed recess provided on the inner surface thereof. An independent cutting blade is slidably secured in each of the recesses in such a manner that the cutting edge of one blade may be exposed beyond the outer periphery of the plates for performing a carpet cutting operation. When the blade becomes dulled or the like, the blade may be retracted from its extended position, and the second blade may be moved into the protruding position for continuing the carpet cutting operation. A yoke means is pivotally secured to the plates and an elongated handle means is secured to the outer end of the yoke means whereby the cutting blade may be manipulated while the user of the device is in a standing position. In this manner, the operator of the tool may walk across the surface of the carpet being removed simultaneously with the cutting of the carpet, thus not only facilitating the physical nature of the operation but also increasing the speed with which the carpet may be cut. The novel carpet cutting tool is simple and efficient in operation and economical and durable in construction.

DETAILED DESCRIPTION OF THE PREFERRED EMBODIMENT

Figure 7:
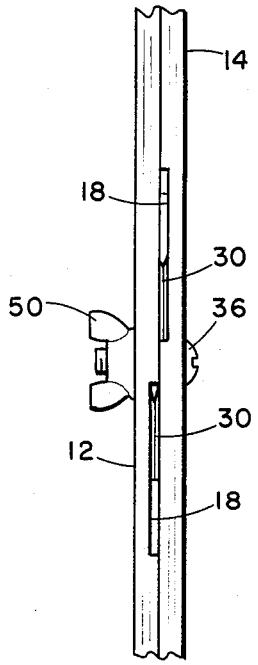
FIG. 7 is a view taken on line 7—7 of FIG. 2.

Referring to the drawings in detail, reference character 10 generally indicates a carpet cutting tool comprising a pair of substantially identical plate members 12 and 14 secured together in substantially planar abuttment in any suitable manner, such as by rivets 16 or the like. Each plate 12 and 14 is preferably of a substantially triangular planar configuration, and each is provided with an elongated recess 18 on one face 19 thereof. Each recess 18 is open at the outer end 20 thereof and the opposite end thereof is closed by a shoulder 22. The longitudinal orientation of each recess 18 is angular with respect to the longitudinal edge 24 of the corresponding plate 12 or 14 for a purpose as will be hereinafter set forth. In addition, each recess 18 is provided with an elongated opening or slot 26 disposed in the proximity of the shoulder 22 and extending longitudinally along the substantially center of the recess 18. An aperture 28 is also provided in each recess 18. An aperture 28 is also provided in each recess 18 for a purpose as will be hereinafter set forth.

Figure 6:
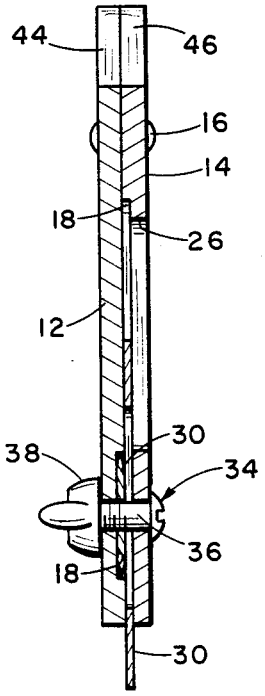
FIG. 6 is a view taken on line 6—6 of FIG. 2.
Figure 8:
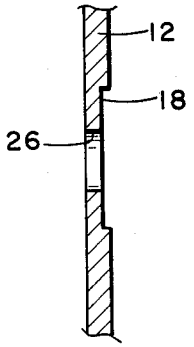
FIG. 8 is a view taken on line 8—8 of FIG. 3.
Figure 9:
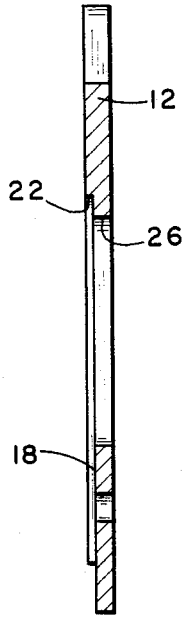
FIG. 9 is a view taken on line 9—9 of FIG. 3.

The plates 12 and 14 are placed in a planar abutting relationship with the face 19 of each plate in position against the face 19 of the other plate. The plates 12 and 14 may then be riveted or otherwise secured together. When the plates 12 and 14 are thus assembled together, one of the recess 18 will be positioned substantially perpendicular with respect to the other recess 18 as particularly shown in FIG. 2. A suitable or typical cutting blade 30 may be slidably inserted into each of the recesses 18. The normal cutting blade 30 is usually provided with a centrally disposed longitudinally extending slot or opening 32 therein. Thus, each blade 30 may be slidably secured within the respective recess 18 by a removable pin means 34 inserted through the aperture 28 of the respective recess 18. The removable pin means 34 may be in the form of a screw 36 (FIG. 6) extending through both plates 12 and 14 and having a suitable single nut 38 threadedly secured to the outer end thereof whereby the blade 30 may be tightly secured within its respective recess 18 in one mode therefor and released from engagement with the recess for facilitating removal or replacement of the blade as will be hereinafter set forth.

Each plate 12 and 14 is provided with a substantially centrally disposed aperture 40 therein and the apertures 40 of the plates are in substantial axial alignment when the plates 12 and 14 are secured together. A yoke means 42 spans the width of the abutting plates 12 and 14 and the spaced arms 44 and 46 of the yoke means 42 are disposed in spaced relation with respect to the outboard faces of the abutting plates 12 and 14. A suitable fastening means, such as a screw 48 and complementary wing nut 50 may extend through the aligned apertures 40 and through the arms 44 and 46 for removably securing the yoke means 42 to the plates 12 and 14. An elongated handle means 52 has one end inserted between the outer ends of the arms 44 and 46 and may be either rigidly secured thereto or may be removably secured thereto, as desired.

The handle means 52 may be of any suitable construction, such as a unitary elongated element, or a plurality of sections secured in end-to-end relation, as desired. It is preferable to provide a first hand grip (not shown) in the proximity of the outer end of the handle means 52, and a second hand grip (not shown) spaced longitudinally inboard of the first hand grip for facilitating manipulation of the tool 10 during a carpet cutting operation. In addition, it may be preferable to provide suitable removable weight means 54 on the handle means 52 in the proximity of the yoke means 42. The weight means 54 may include a spring loaded knob means 56, if desired. Of course, there is no intention of limiting the invention to the use of weight means as shown herein.

Figure 1:
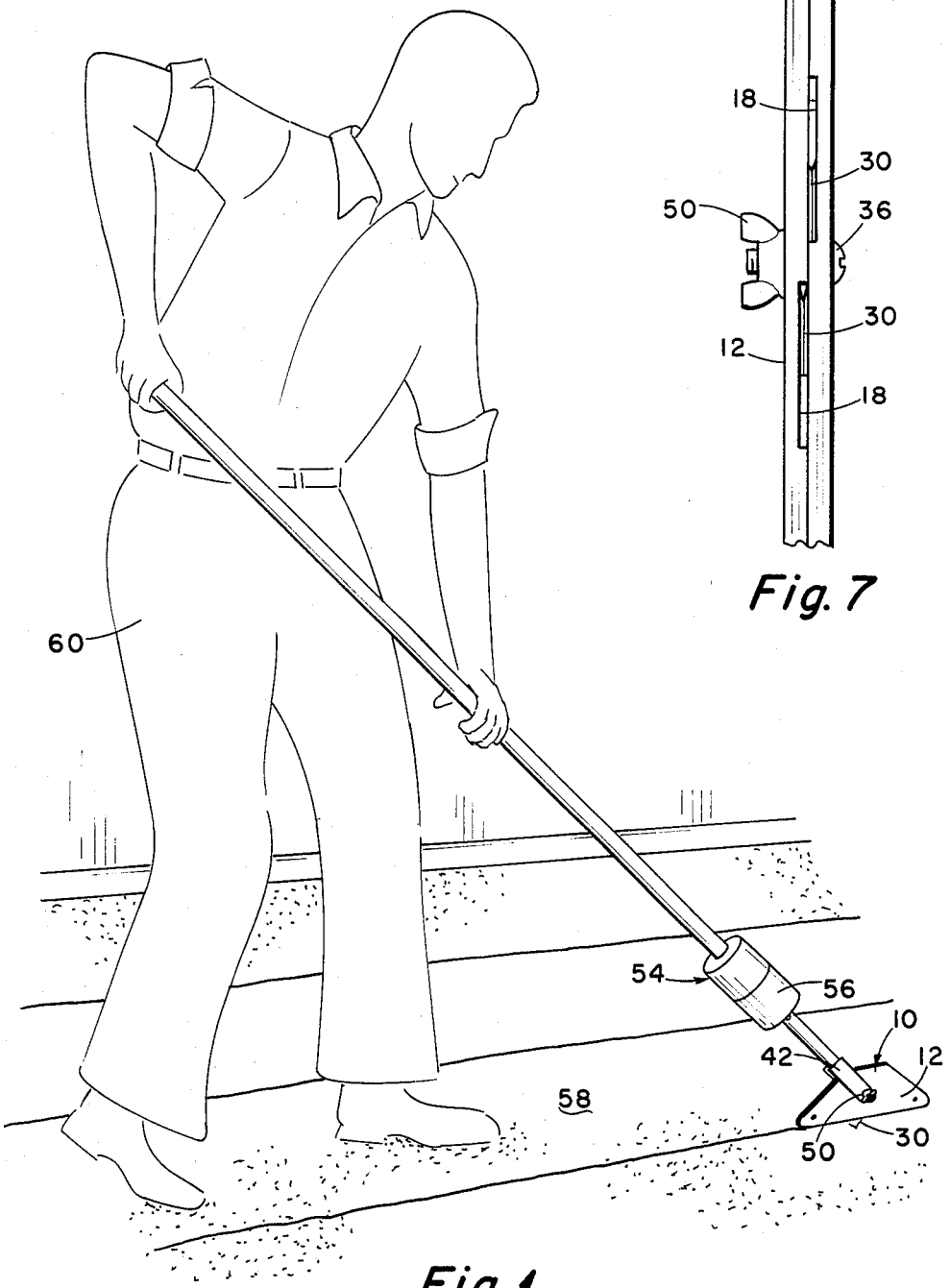
FIG. 1 is a perspective view of a carpet cutting tool embodying the invention and illustrated as in use during a carpet cutting operation.
Figure 5:
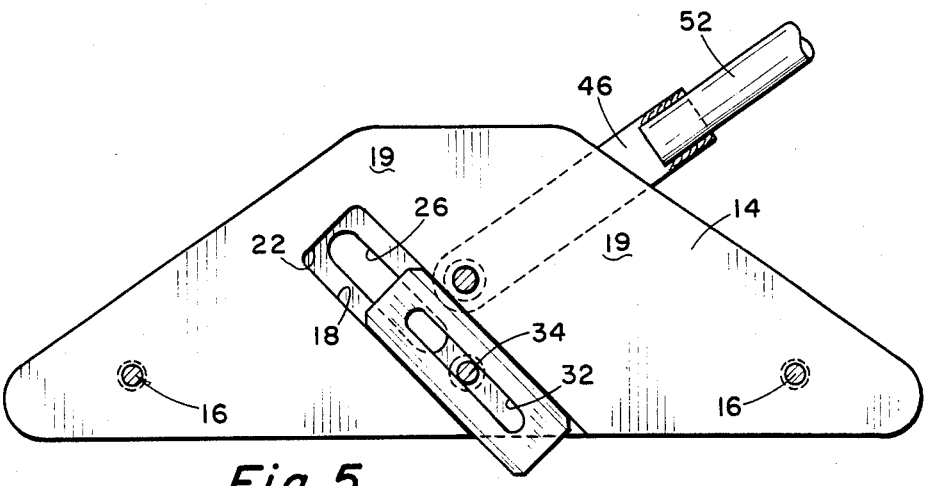
FIG. 5 is a view taken on line 5—5 of FIG. 4.
Figure 2:
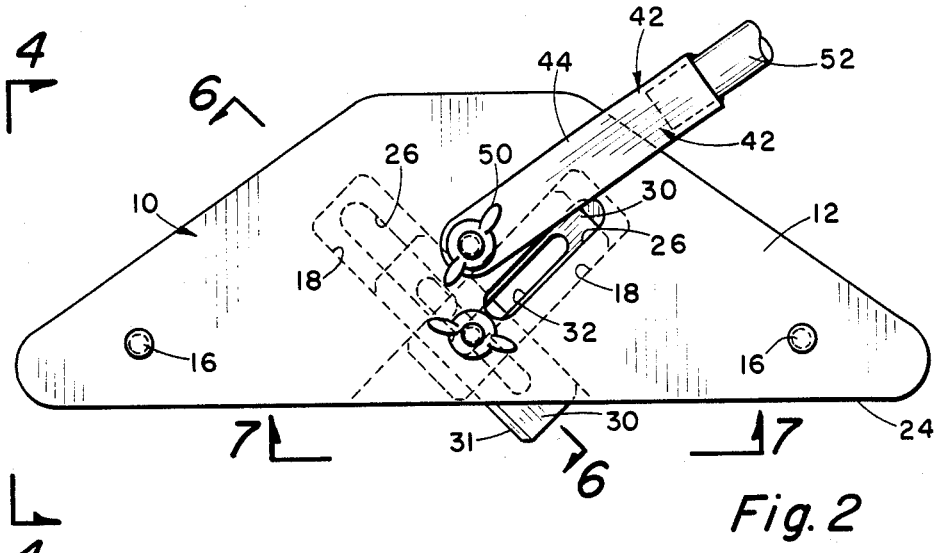
FIG. 2 is a side elevational view of a carpet cutting tool embodying the invention, with the handle means shown broken for purposes of illustration.
Figure 3:
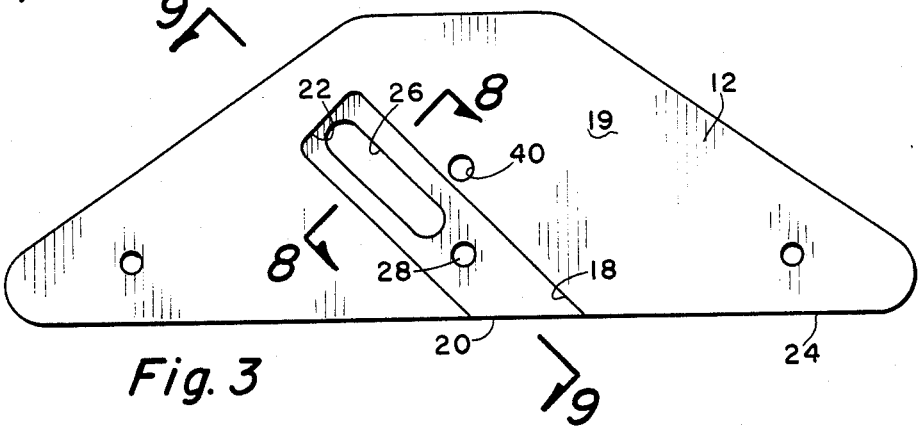
FIG. 3 is a side elevational view of one plate member utilized in a carpet cutting tool embodying the invention.
Figure 4:
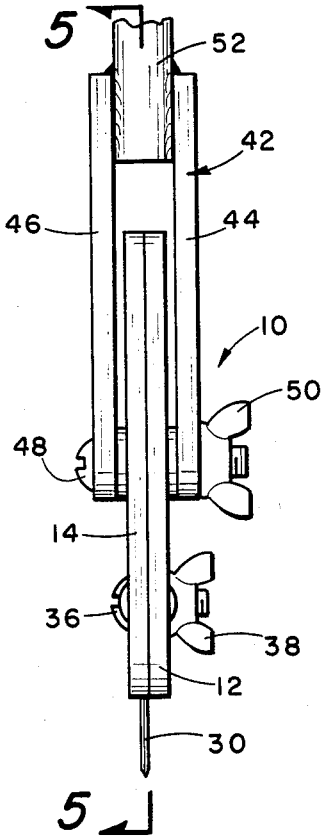
FIG. 4 is a view taken on line 4—4 of FIG. 2.

When the tool 10 is to be used for cutting a carpet 58 which has been glued or otherwise adhered to a floor surface, one of the blades 30 may be adjusted within its respective recess 18 in any well known manner whereby at least one corner or edge 31 thereof extends beyond the edge 24 of the plates 12 and 14 as particularly shown in FIGS. 2 and 5. The blade may be secured in the selected position by tightening of the wind nut means 38 as is well known. The operator 60 of the tool 10 may then grasp the handle means 52 while disposed in a substantially upright or standing position as shown in FIG. 1. The edges 24 of the plates 12 and 14 may be placed against the outer surface of the carpet 58 in such a manner that the edge 31 of the blade 30 penetrates the carpet, and the operator 60 may walk over the surface of the carpet 58 simultaneously with the pushing of the plates 12 and 14 and cutting blade 31 along the carpet, thus cutting the carpet rapidly and with ease. In the event the cutting edge 31 of the blade becomes dull, the operator 60 may loosen the wing nut means 38 and move the dulled blade 30 longitudinally within its recess 18 and against the shoulder 22 thereof, and slide the other blade 30 longitudinally outwardly with respect to its recess 18 for exposing the cutting edge 31 of the second blade. The carpet cutting operation may then be continued. Of course, the blades may be reversed within their respective slots for exposing other cutting corners or edges as is well known.

From the foregoing it will be apparent that the present invention provides a novel carpet cutting tool particularly designed and constructed for facilitating the removal of carpet which has been installed on a floor surface by glueing, or the like. The novel tool provided two cutting blades secured between a pair of side plates in a manner whereby the blades may be readily adjusting to an efficient cutting position. In addition, the plates are pivotally secured to an elongated handle means whereby the entire carpet cutting operation may be achieved from a substantially upright or standing position of the operator.

Whereas the present invention has been described in particular relation to the drawings attached hereto, it should be understood that other and further modifications, apart from those shown or suggested herein may be made within the spirit and scope of this invention.

What is claimed is:

1. A carpet cutting tool for removal of installed carpet from a floor surface, the tool comprising a pair of substantially identical plates secured together in planar abutting relation, each plate being provided with recess means for slidbly receiving an independent cutting blade means therein, independent cutting blade means for each plate, means for slidably securing the cutting blade means in the respective recess whereby a selected cutting edge of a blade may be exposed for accomplishing a cutting operation, and elongated handle means pivotally secured to the plates whereby the plates may be moved over the surface of the carpet for cutting thereof while an operator of the tool remains in a substantially upright position.

2. A carpet cutting tool as set forth in claim 1 wherein the handle means comprises a yoke means having one end pivotally secured to the outboard faces of the plates, and elongated shaft means secured to the opposite end thereof for manipulation of the tool by the operator in said substantially upright position.

3. A carpet cutting tool as set forth in claim 1 wherein the recess means comprises an elongated recess provided in the inwardly directed surface of each plate, the recess of each plate being angularly disposed with respect to a longitudinal edge of the respective plate whereby the recesses are substantially mutually perpendicular and intersecting.

4. A carpet cutting tool as set forth in claim 3 wherein the cutting blade of one recess is disposed substantially co-planar with respect to the cutting blade of the other recess but substantially perpendicular with respect thereto.

5. A carpet cutting tool as set forth in claim 4 wherein each of the recesses has one closed end and one open end, the respective cutting blades being movable within the respective recess for selectively exposing a cutting edge thereof through the open end of the respective recess.

* * * * *